US005515245A

United States Patent [19]

Bobcza et al.

[11] Patent Number: 5,515,245

[45] Date of Patent: May 7, 1996

[54] APPARATUS FOR RELEASABLY ATTACHING A LAMP ON A REFLECTOR OF A MOTOR VEHICLE HEADLIGHT

[75] Inventors: Jan Bobcza, Lippstadt; Heinrich Sottmann, Erwitte, both of Germany

[73] Assignee: Hella KG Hueck & Co., Lippstadt, Germany

[21] Appl. No.: 269,532

[22] Filed: Jul. 1, 1994

[30] Foreign Application Priority Data

Jul. 10, 1993 [DE] Germany ..... 43 23 118.7

[51] Int. Cl.[6] ..... F21M 7/00

[52] U.S. Cl. ..... 362/61; 362/306

[58] Field of Search ..... 362/226, 61, 306

[56] References Cited

U.S. PATENT DOCUMENTS

| | | | |
|---|---|---|---|
| 4,631,651 | 12/1986 | Bergin et al. | 362/267 |
| 4,794,500 | 12/1988 | Bradley | 362/226 |
| 4,819,133 | 4/1989 | Kochi et al. | 361/61 |
| 4,819,142 | 4/1989 | Lothamer et al. | 362/226 |
| 4,947,294 | 8/1990 | Van Duyn et al. | 362/61 |
| 5,010,455 | 4/1991 | Luallin et al. | 362/61 |
| 5,402,325 | 3/1995 | Wisler et al. | 362/61 |

FOREIGN PATENT DOCUMENTS

| | | |
|---|---|---|
| 0292200B1 | 9/1993 | European Pat. Off. . |
| 3425291A1 | 1/1986 | Germany . |
| 3634428A1 | 4/1988 | Germany . |

*Primary Examiner*—Leonard E. Heyman

*Attorney, Agent, or Firm*—Griffin, Butler, Whisenhunt & Kurtossy

[57] ABSTRACT

A lamp (5) is mounted from a rear side of a motor vehicle headlight in an opening (4) at a crown of a reflector (3) of the headlight. A socket (6) of the lamp has a surrounding flange (11) with radial positioning ears (12) extending outwardly therefrom. The opening of the reflector is surrounded by an attaching ring (15) made of resinous-plastic and having spring tongues (16) formed thereon. The positioning ears of the lamp, can be moved between the tongues and the lamp can be screwed about its length axis so as to interengage the positioning ears with the spring tongues. In an end position of the lamp, the spring tongues lie biased against the positioning ears, pressing the flange of the lamp against a seating surface (26) which is formed on an inner rim portion of the attaching ring. The inner rim portion is arranged between the spring tongues and the reflector, to be spaced from the spring tongues.

16 Claims, 4 Drawing Sheets

APPARATUS FOR RELEASABLY ATTACHING A LAMP ON A REFLECTOR OF A MOTOR VEHICLE HEADLIGHT

BACKGROUND OF THE INVENTION

This invention concerns an apparatus to releasably attach a lamp to a reflector of a motor vehicle headlight, wherein the reflector has an opening therethrough for receiving the lamp, with a glass bulb of the lamp extending through the opening in the reflector from a rear side thereof, the lamp having a socket with a surrounding flange with radially positioned ears extending outwardly therefrom for extending between and engaging spring tongues formed on a resinous-plastic attaching ring affixed to the reflector surrounding the opening after a screwing-on motion of the lamp about its length axis, the positioning ears gliding along beveled contact surfaces of the tongues until the tongues, in an end position of the lamp, lie biased against the positioning ears and the flange of the socket is pressed against a seating surface facing an opposite direction from a mounting direction of the lamp.

In a known apparatus of European Patent 0 292 200 A2 for releasably attaching a lamp to a reflector of a motor vehicle headlight, not only is an attaching ring constructed of resinous-plastic but the reflector is as well. The plastic used for making the attaching ring, as well as the plastic for the reflector, must not only be heat resistant and rigid, but must also have sufficient elasticity that the spring tongues of the attaching ring can be formed thereon. Therefore, the resinous-plastic used for the attaching ring has been relatively more expensive than the plastic for the reflector. Since, however, the attaching ring is quite small relative to the reflector, this expensive plastic for the attaching ring increases the overall costs for the headlight only a little.

A glass bulb of the lamp encloses a lamp filament and a socket of the lamp is of resinous-plastic. An electric plug contact is on a rear side of the socket so that a free end thereof extends radially outwardly. A flange is surroundingly formed on the socket between the glass bulb and the plug contact to have three radial positioning ears extending outwardly therefrom, the flange being substantially thicker than the positioning ears. The positioning ears are spaced from a surface of the flange which faces in a mounting direction of the lamp. A surrounding groove is in the socket of the lamp between the flange and the glass bulb for receiving an o-ring seal.

An opening of the reflector for receiving the lamp is surrounded, on an interior side thereof, by a collar on whose interior surface the lamp sealingly lies after it has been mated with the o-ring seal surrounding the socket. An edge portion at the opening of the reflector has a seating surface for the flange of the socket of the lamp. After the lamp has been mounted, spring arms of the attaching ring lie on the positioning ears, under bias, and press the flange against the seating surface of the reflector. Thus, not only is a holding force for the attaching ring generated between the reflector and the reflector-mounted attaching ring, but also a high tension force for attaching the lamp. So that attaching measures of the reflector and the attaching ring can accept these additional high tension forces, they must be appropriately rigid. An attaching measure on the reflector includes a flange-like protrusion formed on the reflector surrounding its seating surface which is directed radially outwardly. So that this protrusion can withstand the additional tension forces and because it, like the reflector, is manufactured of a brittle plastic, it must have a correspondingly thick wall. Because of this, indentations can develop on an interior surface of the reflector or, if these do not develop, the reflector, in areas of its reflection surface, must have a wall as thick as the flange-like protrusion. The attaching ring grips behind the flange-like protrusion of the reflector with detent tabs which are formed on an outer surrounding edge of the attaching ring with their free ends extending in a mounting direction of the lamp. So that radially inwardly directed spring arms of the attaching ring always attach the lamp with a sufficiently large axial force, a spacing between the spring arms (that is their contact surfaces) and the seating surface of the reflector facing the spring arms, must have a correspondingly small tolerance. Maintaining such a small tolerance in the practice is quite difficult because it is a sum of a plurality of smaller tolerances. It is further disadvantageous that the attaching ring can only be affixed to a reflector which has an exact seating surface customed for a particular lamp.

It is an object of this invention to provide an apparatus for releasably attaching a lamp on a reflector of a motor vehicle headlight in a system of the type mentioned in the introductory paragraph in which, after the lamp has been mounted, axial forces developed by spring tongues of an attaching ring cannot affect a fastening coupling between the attaching ring and the reflector so that the fastening coupling, also when the spring tongues exert a great force against positioning ears, can be made with the smallest possible dimensions. It is a further object of this invention to provide such an apparatus for which a fixed seating of the lamp is also assured even if the attaching ring is universally used with many different headlights, and, even when, for example, the headlights have heat deformed reflectors in areas of lamp-receiving openings thereof. It is still a further object of this invention to provide such an apparatus for which a reflector, in an area of its lamp-receiving opening, can be uncomplicatedly formed and no additional parts are necessary in order to attach the lamp.

SUMMARY OF THE INVENTION

According to principles of this invention, an attaching ring is formed as one piece to have spring tongues and an inner rim portion which extends between the spring tongues and a reflector, the inner rim portion being spaced from adjacent slanted surfaces of the tongues and with a side of the inner rim portion facing the tongues having a seating surface for a flange of a socket of a lamp.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
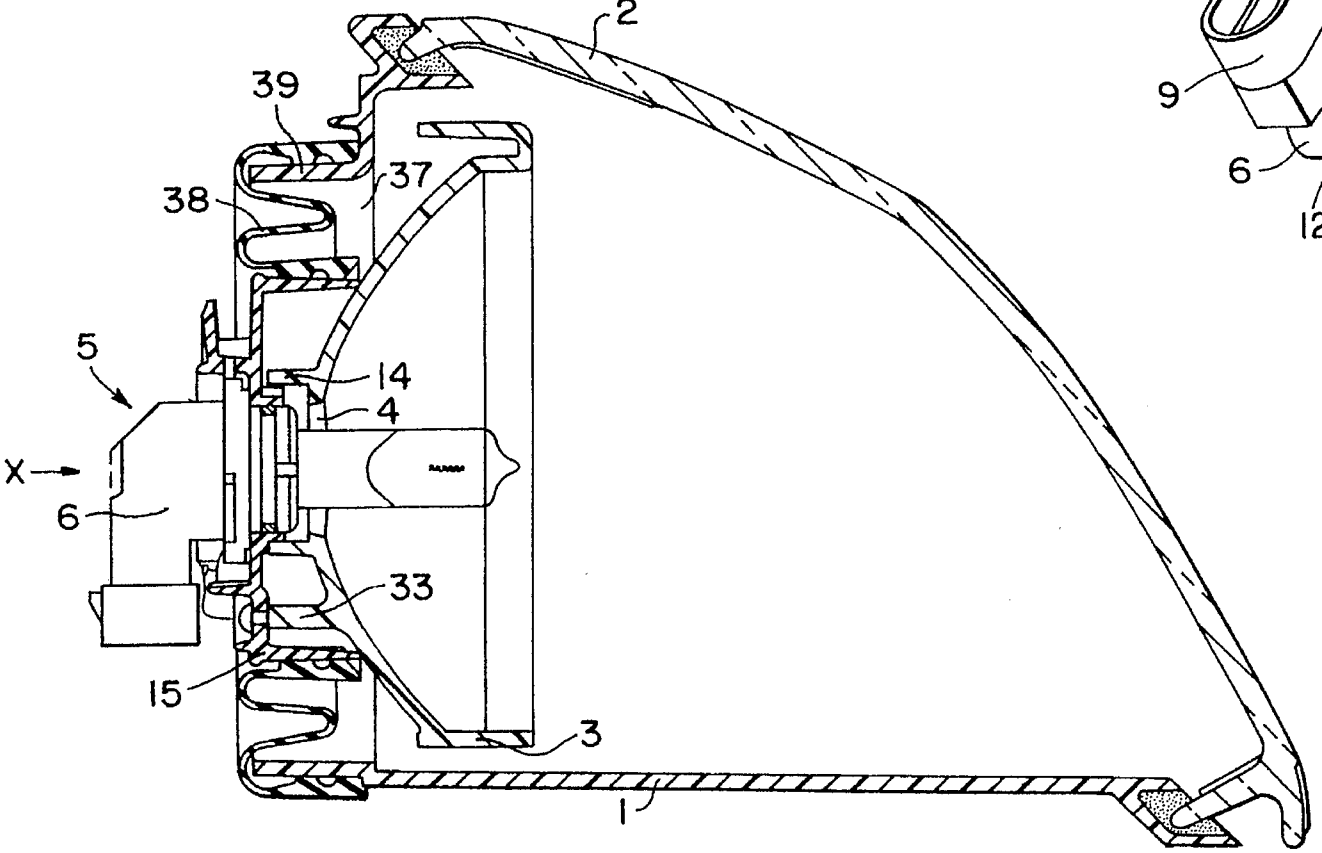
FIG. 1 is a middle, vertical, lengthwise, cross sectional view of a headlight for a motor vehicle with a first-embodiment of this invention for releasably attaching a lamp on a reflector of the motor vehicle headlight.
Figure 4:
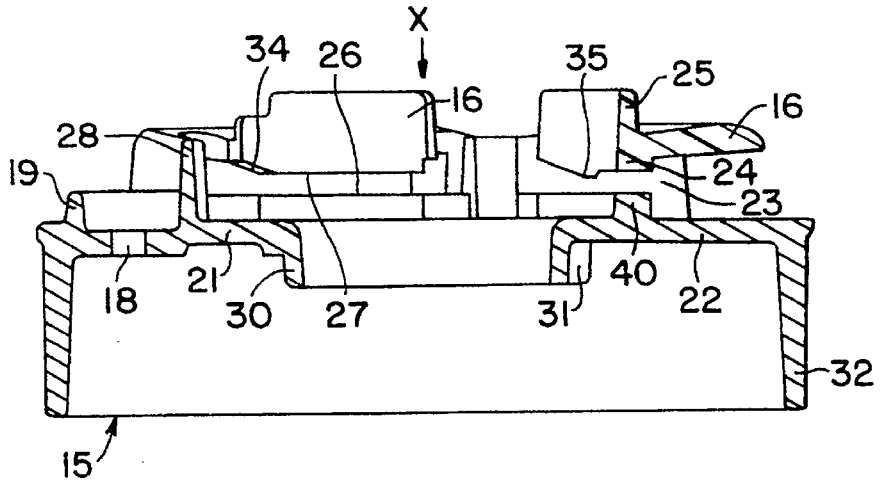
FIG. 4 is a cross sectional view taking on line IV—IV in FIG. 3.
Figure 3:
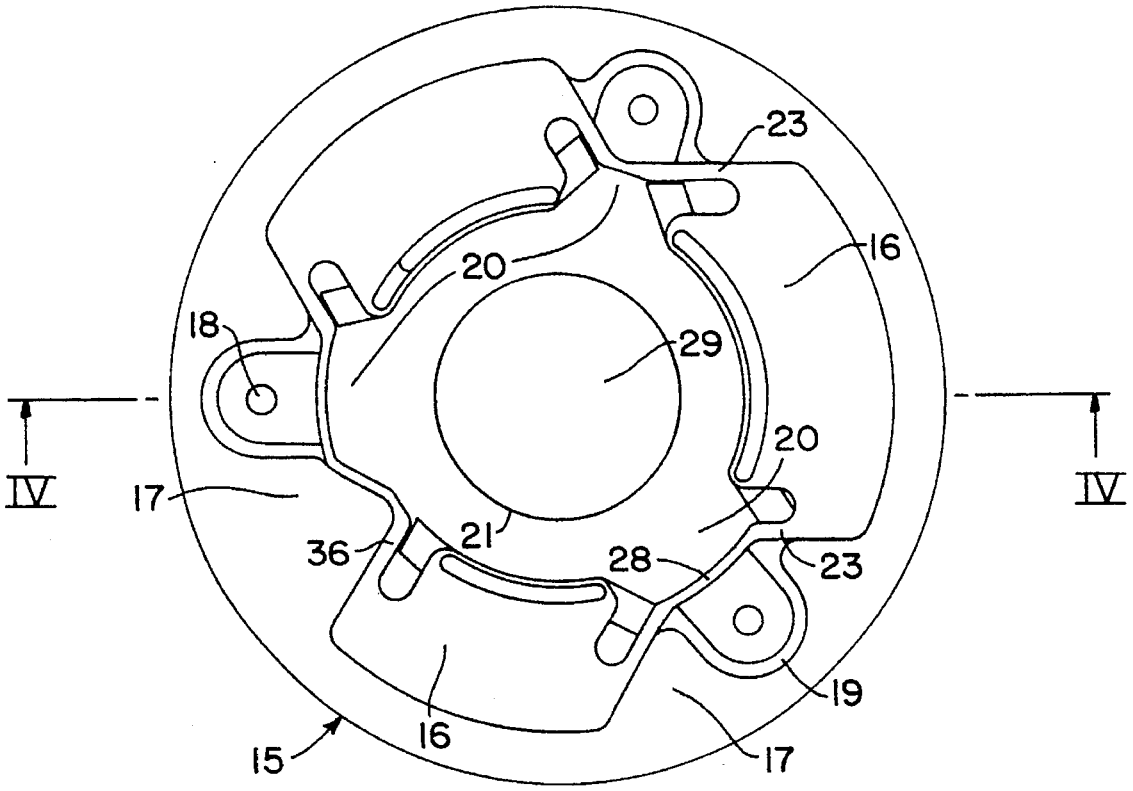
FIG. 3 is a view taken in a direction X in FIG. 1 toward a rear side of the headlight, but showing an attaching ring thereof as an individual part.

A motor vehicle headlight (see FIG. 1) has a pot-shaped housing 1 of resinous-plastic whose front opening is sealingly closed by a bowl-shaped light-transmissive shield 2. In an interior space of the motor vehicle headlight, formed by the enclosing light-transmissive shield 2 and the housing 1, a bowl-shaped reflector 3 is coupled to the housing 1 by adjusting elements (not shown) to be thereby pivotal about at least one axis. The reflector 3 is manufactured of a high-heat resistant, or brittle, resinous-plastic. The bowl-shaped reflector 3 has, in an area of its crown, an opening 4 for receiving a lamp 5.

Figure 2:
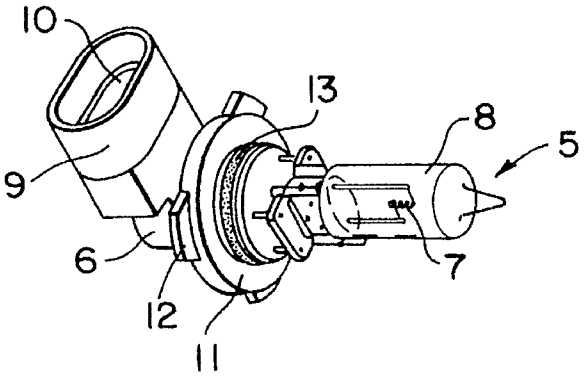
FIG. 2 is a perspective view of the lamp of FIG. 1.

The lamp 5, which is shown as an individual element in FIG. 2, has a socket 6 manufactured of resinous-plastic which supports on its front side a glow filament 7 surrounded by a glass bulb 8 and on its rear side a housing portion 9, formed as one piece therewith, which is open radially outwardly and in whose interior a receptacle 10 for the lamp 5 is arranged. A flange 11 is formed on the socket between the housing portion 9 and the glass bulb 8 so as to extend radially outwardly about the socket 6 with three positioning ears 12 being supported on an outwardly directed surface thereof. The flange 11 is substantially thicker than the positioning ears 12. The surfaces of the positioning ears 12 and the flange 11 which are facing toward the rear side of the lamp 5 lie in a plane, while the surfaces of the positioning ears and the flange which face the front side of the lamp 5 are axially spaced from one another. Between the flange 11 and the glass bulb 8 a surrounding groove is in the socket 6 for receiving an o-ring seal 13.

The opening 4 in the reflector 3 is surrounded by a neck 14 extending toward the rear side of the motor vehicle headlight. An attaching ring 15, of high-temperature resistant, rigid, and elastic, resinous-plastic is affixed on the rear side of the reflector. The attaching ring 15 has three, radially inwardly directed spring tongues 16. Ring portions 17, which extend between the tongues, have attaching features 18, which include through openings in the ring portions 17. The through openings are surrounded by ribs 19 extending toward the rear of the headlight. The three ring portions 17 are arranged, as seen in a light travelling direction, to be spaced from a plane of the tongues 16 toward the reflector 3. Between free end edge portions of the tongues 16 are free areas, or recesses, 20 through which positioning ears 12 of the lamp 5 can be moved, or manipulated. After such a manipulation, the flange 11 of the lamp 5 lies on a surrounding inner rim portion 21 of the attaching ring 15. Radially outwardly directed wall portions 22 are formed on the inner rim portion 21 to extend beneath the tongues 16. The inner rim portion 21 and the wall portions 22 formed thereon, extend with the ring portions 17 substantially in one plane to form a one piece, ring-shaped, disc whose central opening 29 has a smaller inner diameter than the opening formed by the free side edge portions of the tongues 16. End walls 23, which respectively couple the spring tongues 16 with the ring portion 17, extend so that their inwardly directed surfaces which face one another (parallel) can be molded with an adjustable mold tool which, upon molding the attaching ring 15, can be moved radially outwardly. At a free edge portion of each tongue 16 is a ridge portion 24 extending toward the reflector 3 and a ridge portion 25 extending away from the reflector 3. The ridge portion 24 has on its surface facing the inner rim portion 21, which forms a seating surface 26 for the flange 11 of the lamp 5, a contact surface 27 for the positioning ears 12. The end walls 23, which couple the spring tongues 16 with the ring portion 17 are, at their ends directed inwardly, coupled to one another by ribs 28 formed on the ring-shaped disc. The central opening 29, surrounded by the inner rim portion 21 has a surrounding collar 30 directed toward the reflector. The collar 30 engages, substantially play free, the interior of the neck 14 of the reflector 3. A shoulder 31 formed on the collar 30, which engages into a corresponding recess at an inner surface of the neck 14 of the reflector 3, assures that the attaching ring 15 does not rotate. The attaching ring 15 is held in place axially by a facing edge of the neck 14 of the reflector 3 against which a surface adjacent the collar 30 impinges. A cylindrical sidewall 32 is formed to be directed toward the reflector 3 at an outer edge of the ring-shaped disc having the central opening 29, which sidewall has an edge surface which at least partially borders on a rear side of the bowl-shaped reflector. The attaching ring 15 is axially affixed to the reflector 3 by rivet-like pins 33 arranged on the rear side of the reflector 3 which extend through the openings 18 in the ring portions 17 of the attaching ring 15 and whose free end portions, which extend from the opening 18, are shaped as heads for seating on edges forming the opening 18. The ribs 19 surrounding the openings 18 form depressions in which sealing elements can be placed.

When the lamp 5 is mounted, with its glass bulb 8 first, it is extended through the opening 29 of the attaching ring 15 and the opening 4 of the reflector 3, whereby the three radial, outwardly-directed positioning ears 12 of the lamp 5 are moved through the free areas 20 between the tongues 16 until the flange 11 of the lamp 5 lies on the seating surface 26 of the inner rim portion 21 of the attaching ring 15. Thereafter, the lamp 5 is rotated about its length axis in a clockwise direction whereby the positioning ears 12 of the lamp interengage with free end portions of the spring tongues 16 and first glide along beveled portions 34 of contact surfaces 27 of the spring tongues 16 until one of the positioning ears snaps behind a raised area 35 and this positioning ear, or another, makes contact with a radially inwardly directed extension 36 of an end wall 23. In this end position of the lamp 5 the contact surfaces 27 of the spring tongues 16 lie, under bias, on the positioning ears of the lamp 5 and press the flange 11 against the inner rim portion 21 of the attaching ring 15. On the Side of the radially outwardly extending wall portion 22, opposite the ridge portion 24 of the spring tongues 16, shoulders 40 are formed which extend close to the positioning ears 12 of the lamp 5. The shoulders 40 are rib-like in shape and extend below the free edges of the tongues 16 from one end wall 23 to another. Thus, slits are developed between the ridge portions 24 of the spring tongues 16 and the rib-like shoulders 40 through which the positioning ears 12 of the lamp 5 are guided upon its being mounted so that the lamp cannot be mounted at a tilt. The lamp 5 lies in its end position with its positioning ears 12 not on the shoulder 40, but rather with its flange 11 on the seating surface 26.

The reflector 3, having the attaching ring 15 mounted thereon and with the lamp 5 mounted in the attaching ring 15, extends from an opening 37 in the rear side of the housing 1. The space between the attaching ring 15 and the surrounding edge of the opening 37 of the housing 1 is covered by a ring-shaped seal 38. The ring-shaped seal 38 extends in cross section in a meandering manner and its inner edge lies under bias on an outer surface of the sidewall 32 of the attaching ring 15, while its outer edge is sealingly placed on a collar 39 surrounding the opening 37 of the housing 1. When the lamp 5 is changed it can be directly accessed from the rear side of the headlight because no covering cap-shaped seal is used for the general opening 37. Further, by means of the meandering-in-cross-section seal, the reflector is easily accessed for adjustment.

Figure 5:
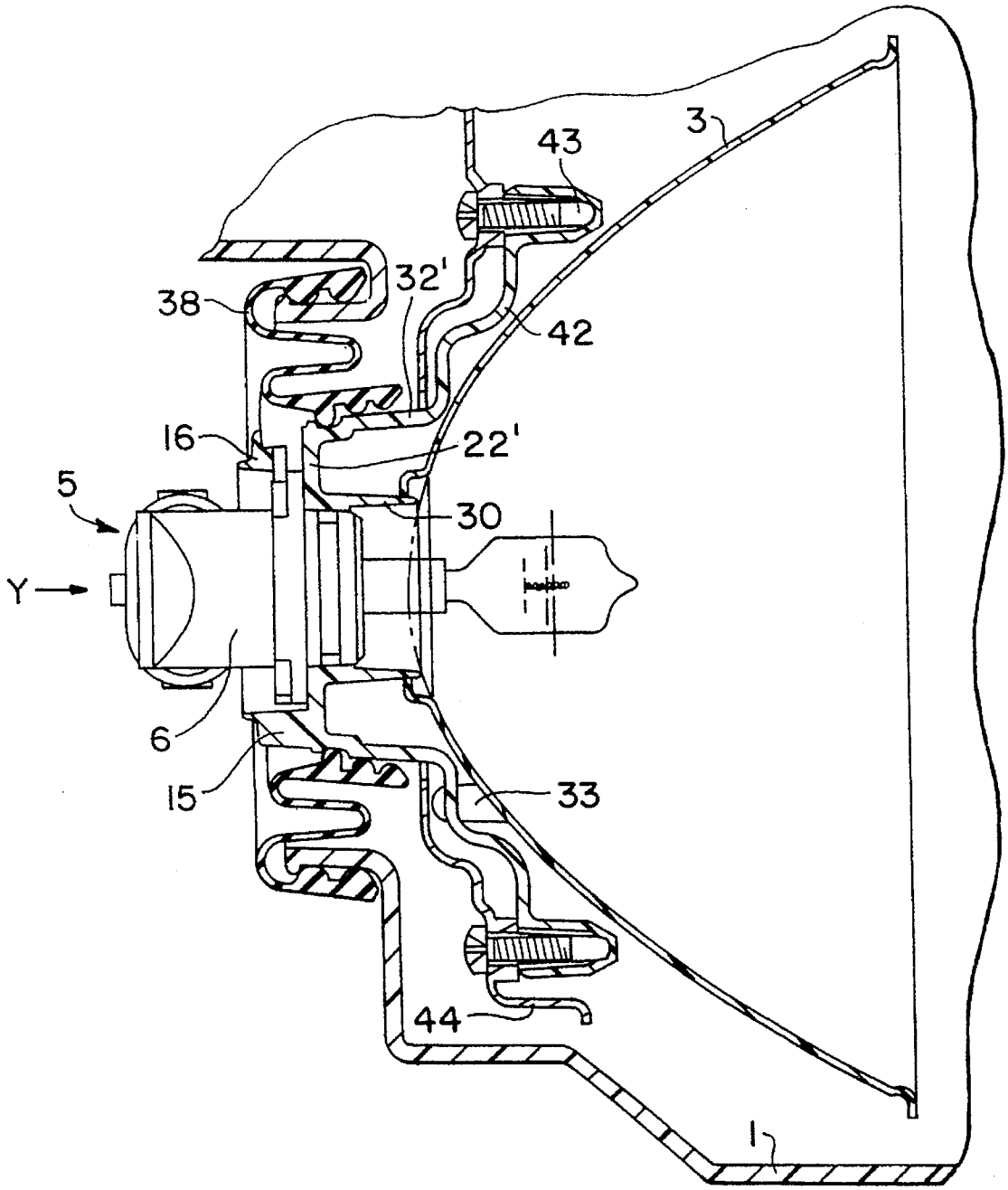
FIG. 5 is a middle, vertical, lengthwise, cross sectional view of a headlight for a motor vehicle with a second-embodiment of this invention for releasably attaching a lamp on a reflector.
Figure 6:
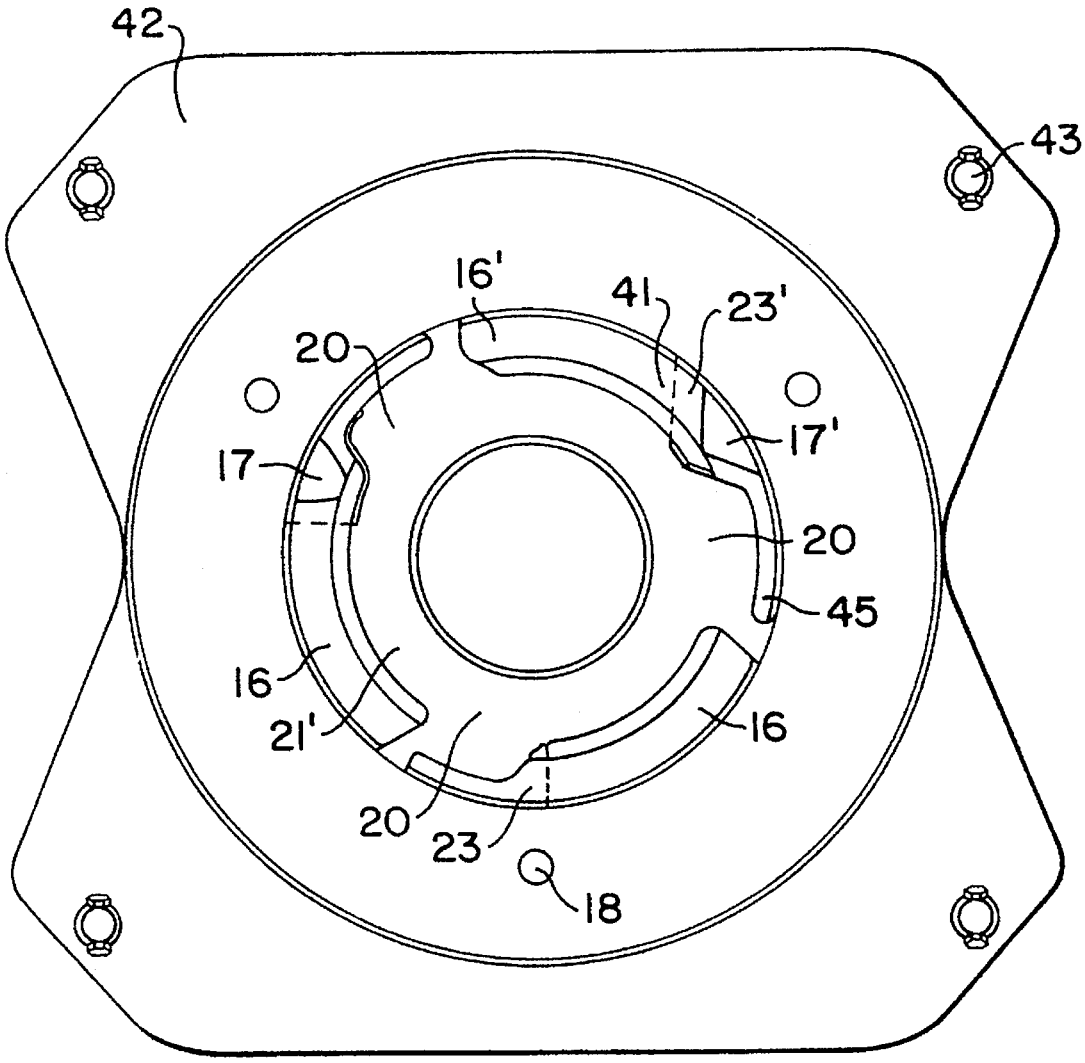
FIG. 6 is a view taken in a direction Y of an attaching ring of the reflector of FIG. 5, as an individual part.

The headlight shown in FIGS. 5 and 6 differs from that of FIGS. 1–4 mainly in that spring tongues 16' extend lengthwise concentric to the length axis of the lamp 5 and an end wall 23' of each is, at its base, attached to a ring-shaped disc including an inner rim portion 21', wall portions 22' and ring portions 17'. At least one of the end walls 23' serves as a stop for the positioning ears 12 of the lamp 5. A sidewall 32 formed on the ring-shaped disc forms a cylinder on which radially outwardly directed narrow edges of the tongue 16' border. The end walls 23' are elongated in a direction of free edges, or ends, of the respectively adjacent tongues 16' and their end portions 45 extend along an outer edge of the ring-shaped disc. At the sidewall 32' of the bowl-shaped ring-shaped disc is an edge portion 42 formed to extend in a spaced relationship to the bowl-shaped reflector 3. Four attaching elements 43 are mounted on the edge portion 42 which rigidly attach the attaching ring 15 to a supporting frame 44. The attaching elements 43 define threaded bores in the edge portion 42 in which threaded shafts of screws engage. The threaded shafts of the screws extend through the bores of the edge portion of the supporting frame 44 with their heads lying on a rear side of the supporting frame 44.

It is beneficial that with this invention the reflector can be constructed of resinous-plastic as well as inexpensive metal. Further, the spacing between the spring tongues and the seating surface for determining an axial attachment position of the lamp is always of a uniform size because it is not between two separate parts so that it cannot be changed by an incorrect mounting of the attaching ring on the reflector. Further, the forces applied by the spring arms to the positioning ears of the lamp can be particularly chosen to be of a magnitude that the lamp cannot come loose by itself from its clamp mounting between the spring arms and the seating surface.

It is further beneficial that the outer ring portions of the attaching ring between two adjacent tongues are offset toward the reflector and are formed as ring portions of the inner rim portion. In this manner, the attaching ring is particularly stiff. In this regard, it is further beneficial that the inner rim portion is circular and that its radial, outwardly-directed, wall portion extends beneath the respective tongues, whereby the wall portion of the inner rim portion is formed from a one-piece, ring-shaped, disc which extends in a spaced relationship to the spring tongues. In this regard, it is further beneficial that the spring tongues are respectively coupled with the ring-shaped disc, which is spaced therefrom toward the reflector, by means of end walls which extend along the undersides of adjacent tongue edges so that their interior sides, together with the undersides of the tongues and the surface of the wall portions facing the tongues, can be molded with dies, or tools, which can be moved radially outwardly during molding of the attaching ring. Such an attaching ring is uncomplicated and can be cost effectively manufactured.

By using tongues having free end edges directed radially inwardly, it is further beneficial that an, outer, narrow, base portion of the end edge of each tongue is connected, via an end wall, or sidewall, with the ring-shaped disc and that the inwardly directed edge of the end wall, between two tongues, changes to a rib on the disc which interconnects the two tongues. By this means, the torsional stiffness of the attaching ring is made particularly great.

Further, it is beneficial that at least one end wall extends radially inwardly so that its inner end can serve as a stop for a positioning ear of the lamp in the end position. Such a solution is uncomplicated and can be cost effectively manufactured.

Still further, it is beneficial that the central opening of the ring-shaped disc is surrounded by a collar directed toward the reflector for extending into the opening of the reflector to radially affix the attaching ring and so that its inner surface can serve to radially affix the lamp. In this manner, the radial affixing of the attaching ring in the reflector is provided in an uncomplicated manner.

Further, it is beneficial that the attaching ring has an attaching feature on the ring-shaped disc with which the attaching ring can be coupled to the reflector. As attaching features, holes can be made in the attaching ring through which protrusions from the reflector can extend for engaging an outer surface of the attaching ring.

A further benefit is provided by the ring-shaped disc having a bowl shape whereby the bowl is open toward the reflector. In this manner, the torsional strength of the attaching ring is quite large. In this regard, it is further beneficial that the free edge of the sidewall of the bowl lies on the rear surface of the reflector. In this manner it is assured that when a lamp is changed no bending moments are applied at attaching positions between the attaching ring and the reflector.

In a particularly beneficial further embodiment of the invention the outer surface of the sidewall of the bowl shaped disc serves as a support surface for the ring-shaped rubber-like cover surrounding the collar whose outer surrounding edge can be sealing placed at an opening of a housing of the motor vehicle headlight. In this manner, with such "a housing headlight", a changing of the lamp can take place without the necessity of dismounting a covering cap.

Additionally it is beneficial that the spring tongues, at their inwardly directed free edges, have ridge portions which are directed opposite to the mounting direction of the lamp. In this manner, it is not possible to position the lamp to be defocused (that is, at an angle in the opening of the reflector), because the ridge portions hinder the positioning ears of the lamp from being moved onto outer surfaces of the spring tongues.

Still further, it is beneficial that the thicknesses of the spring tongues get smaller, or are wedge shaped, toward their free end edges. In this manner, their pressing force as well as axial spring travel of the tongues can be optimized.

In a further, particularly beneficial, embodiment of the invention, a single end wall of each respective tongue base is coupled with the ring-shaped disc and the spring tongues extend in their elongation concentric to the length axis of the lamp. In this manner the attaching ring, in the areas of its spring tongues and its ring-shaped disc, has an outer diameter which is so small that, in these areas, parts do not extend radially outwardly beyond the spring tongues and these areas can therefore extend in a correspondingly small opening of a housing of the headlight.

Further, it is beneficial that the attaching elements are placed on the outer edge portion of the bowl shaped disc by means of which the attaching ring can be attached to a supporting frame. In this manner, the attaching ring can support the lamp as well as the reflector and, nevertheless, the attaching elements which couple the attaching ring to the reflector can be dimensioned quite small because the attaching elements support a reflector with which adjusting apparatus of the headlight cannot bring about an internal tension force and which can be manufactured to have a very thin wall.

The embodiments of the invention in which an exclusive property or privilege are claimed are defined as follows:

1. Apparatus to releasably attach a lamp to a reflector of a motor vehicle headlight, wherein the reflector has an opening therein for receiving the lamp, with a glass bulb of the lamp extending through the reflector from a rear side thereof, the lamp having a socket with a surrounding flange from which radial positioning ears extend outwardly for engaging a plastic attaching ring which is affixed to the reflector so as to surround the opening, said plastic attaching ring having spring tongues formed thereon between which the positioning ears of the lamp socket can be placed for engaging the positioning ears with the spring tongues upon a screwing motion of the lamp about its length axis so that the positioning ears glide along tongue contact surfaces until the tongues, at an end position of the lamp, lie biased against the positioning ears, with the flange of the socket pressing against a ring contact surface facing in an opposite direction from a mounting direction of the lamp;

wherein the attaching ring is formed as one piece to comprise the spring tongues and an inner rim portion extending in a spaced relationship to the tongue contact surfaces between the spring tongues and the reflector, said inner rim portion providing the ring contact surface facing the tongues for engaging the flange of the socket of the lamp;

wherein the inner rim portion is circular and has a radially outwardly directed wall portion extending beneath the respective tongues;

wherein the wall portion of the inner rim portion is formed from a one piece ring-shaped disc extending in spaced relationship to the spring tongues; and wherein the ring-shaped disc has a bowl shape, with the bowl being open towards the reflector.

2. Apparatus as in claim 1 wherein an outer ring portion of the attaching ring extends between two adjacent tongues so as to be offset toward the reflector and the inner rim portion is formed on the outer ring portion.

3. Apparatus according to claim 1 wherein each tongue of said spring tongue is respectively coupled to the ring-shaped disc, which is arranged to be displaced from the reflector 3, by end walls whose inner sides, which border the underside of the respective tongue, extend so that they, together with the underside of the tongue and the side of the wall portion facing the tongue, can be molded during molding of the attaching ring by a mold part of an adjustable mold which can be moved outwardly.

4. Apparatus as in claim 3 wherein free end edges of the tongues are directed radially inwardly, with each tongue being coupled to the ring-shaped disc via the end walls at narrow, outer, base end edges, with inwardly directed edges of the end walls arranged between two tongues changing into coupling ribs formed on the disc.

5. Apparatus according to claim 3 wherein at least one end wall extends inwardly so far that an inner edge thereof serves as a stop for the positioning ears of the lamp at an end position.

6. Apparatus according to claim 3 wherein each spring tongue is respectively coupled to the ring-shaped disc by means of a single end wall at a base of the spring tongue, with the tongue extending lengthwise therefrom, concentric to the length axis of the lamp.

7. Apparatus according to claim 1 wherein a central opening of the ring-shaped disc is surrounded by a collar directed towards the reflector which extends substantially, play free, through an opening in the reflector and whose inner side surface serves to radially hold the lamp socket.

8. Apparatus according to claim 1 wherein the attaching ring has an attaching element on the ring-shaped disc for attaching it to the reflector.

9. Apparatus according to claim 1 wherein a free edge portion of a cylindrical sidewall of the bowl lies on a rear side of the reflector.

10. Apparatus according to claim 1 wherein an outer surface of a sidewall of the ring disc serves as a seating surface on the attaching ring for a biased, surrounding, ring-shaped, rubber-like cap whose outer surrounding edge can be placed at an opening of a housing of the motor vehicle headlight.

11. Apparatus according to claim 1 wherein inwardly-directed free edges of the spring tongues have ridge portions which are directed in a direction opposite to a mounting direction of the lamp.

12. Apparatus according to claim 1 wherein the spring tongues have free end edges, the spring tongues tapering to become thinner toward the free end edges thereof.

13. Apparatus according to claim 1 wherein an attaching means is mounted at an outer edge portion of an end wall of the ring-shaped disc, which has a bowl shape, for attaching the attaching ring to a supporting frame.

14. Apparatus to releasably attach a lamp to a reflector of a motor vehicle headlight, wherein the reflector has an opening therein for receiving the lamp, with a glass bulb of the lamp extending through the reflector from a rear side thereof, the lamp having a socket with a surrounding flange from which radial positioning ears extend outwardly for engaging a plastic attaching ring which is affixed to the reflector so as to surround the opening said plastic attaching ring having spring tongues formed thereon between which the positioning ears of the lamp socket can be placed for engaging the positioning ears with the spring tongues upon a screwing motion of the lamp about its length axis so that the positioning ears glide along tongue contact surfaces until the tongues, at an end position of the lamp, lie biased against the positioning ears, with the flange of the socket pressing against a ring contact surface facing in an opposite direction from a mounting direction of the lamp;

wherein the attaching ring is formed as one piece to comprise the spring tongues and an inner rim portion extending in a spaced relationship to the tongue contact surfaces between the spring tongues and the reflector, said inner rim portion providing the ring contact surface facing the tongues for engaging the flange of the socket of the lamp;

wherein the inner rim portion is circular and has a radially outwardly directed wall portion extending beneath the respective tongues;

wherein the wall portion of the inner rim portion is formed from a one piece ring-shaped disc extending in spaced relationship to the spring tongues;

wherein each tongue of said spring tongues is respectively coupled to the ring-shaped disc, which is arranged to be displaced from the reflector, by end walls whose inner sides, which border the underside of the respective tongue, extend so that they, together with the underside of the tongue and the side of the wall portion facing the tongue, can be molded during molding of the attaching ring by a mold part of an adjustable mold which can be moved outwardly.

15. Apparatus to releasably attach a lamp to a reflector of a motor vehicle headlight, wherein the reflector has an opening therein for receiving the lamp, with a glass bulb of the lamp extending through the reflector from a rear side thereof, the lamp having a socket with a surrounding flange from which radial positioning ears extend outwardly for engaging a plastic attaching ring which is affixed to the reflector so as to surround the opening said plastic attaching ring having spring tongues formed thereon between which the positioning ears of the lamp socket can be placed for engaging the positioning ears with the spring tongues upon a screwing motion of the lamp about its length axis so that the positioning ears glide along tongue contact surfaces until the tongues, at an end position of the lamp, lie biased against the positioning ears, with the flange of the socket pressing against a ring contact surface facing in an opposite direction from a mounting direction of the lamp;

wherein the attaching ring is formed as one piece to comprise the spring tongues and an inner rim portion extending in a spaced relationship to the tongue contact surfaces between the spring tongues and the reflector, said inner rim portion providing the ring contact surface facing the tongues for engaging the flange of the socket of the lamp;

wherein an attaching means is mounted at an outer edge portion of an end wall of the ring-shaped disc, which has a bowl shape, for attaching the attaching ring to a supporting frame.

16. Apparatus to releasably attach a lamp to a reflector of a motor vehicle headlight, wherein the reflector has an opening therein for receiving the lamp, with a glass bulb of the lamp extending through the reflector from a rear side thereof, the lamp having a socket with a surrounding flange from which radial positioning ears extend outwardly for engaging a plastic attaching ring which is affixed to the reflector so as to surround the opening said plastic attaching ring having spring tongues formed thereon between which the positioning ears of the lamp socket can be placed for engaging the positioning ears with the spring tongues upon a screwing motion of the lamp about its length axis so that the positioning ears glide along tongue contact surfaces until the tongues, at an end position of the lamp, lie biased against the positioning ears, with the flange of the socket pressing against a ring contact surface facing in an opposite direction from a mounting direction of the lamp;

wherein the attaching ring is formed as one piece to comprise the spring tongues and an inner rim portion extending in a spaced relationship to the tongue contact surfaces between the spring tongues and the reflector, said inner rim portion providing the ring contact surface facing the tongues for engaging the flange of the socket of the lamp;

wherein the inner rim portion is circular and has a radially outwardly directed wall portion extending beneath the respective tongues;

wherein the wall portion of the inner rim portion is formed from a one piece ring-shaped disc extending in spaced relationship to the spring tongues;

wherein each spring tongue is respectively coupled to the ring-shaped disc by means of a single end wall at a base of the spring tongue, with the tongue extending lengthwise therefrom, concentric to the length axis of the lamp.

* * * * *